US008852835B2

(12) United States Patent
Kmiecik-Lawrynowicz et al.

(10) Patent No.: US 8,852,835 B2
(45) Date of Patent: Oct. 7, 2014

(54) BLACK TONER

(71) Applicant: Xerox Corporation, Norwalk, CT (US)

(72) Inventors: Grazyna E Kmiecik-Lawrynowicz, Fairport, NY (US); Michael F Zona, Holley, NY (US); Mark E Mang, Rochester, NY (US); Maura A Sweeney, Irondequoit, NY (US); Robert D Bayley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 33 days.

(21) Appl. No.: 13/711,621

(22) Filed: Dec. 12, 2012

(65) Prior Publication Data

US 2014/0162181 A1 Jun. 12, 2014

(51) Int. Cl.
*G03G 9/08* (2006.01)

(52) U.S. Cl.
CPC ..... *G03G 9/0819* (2013.01); *G03G 9/0827* (2013.01)
USPC ..... 430/108.1; 430/108.9; 430/109.3

(58) Field of Classification Search
USPC ..... 430/108.1, 108.9, 109.3
See application file for complete search history.

(56) References Cited

U.S. PATENT DOCUMENTS

| | | | | |
|---|---|---|---|---|
| 6,348,291 | B1 * | 2/2002 | Sato | 430/108.6 |
| 2002/0086229 | A1 * | 7/2002 | Yuasa et al. | 430/108.4 |
| 2008/0107988 | A1 * | 5/2008 | Vandewinckel et al. | 430/109.3 |
| 2009/0047592 | A1 * | 2/2009 | Okamoto et al. | 430/109.3 |
| 2009/0136863 | A1 * | 5/2009 | Asarese et al. | 430/108.1 |
| 2010/0330484 | A1 * | 12/2010 | Seitoku | 430/107.1 |
| 2011/0064927 | A1 * | 3/2011 | Deprez et al. | 428/207 |

* cited by examiner

*Primary Examiner* — Hoa V Le
(74) *Attorney, Agent, or Firm* — MDIP LLC

(57) ABSTRACT

The present disclosure describes a black single component toner with desirable fusing performance.

20 Claims, No Drawings

BLACK TONER

FIELD

A black toner of desired properties, such as, gloss and fusing performance; devices comprising the black toner; imaging device components comprising the black toner; imaging devices comprising the black toner; and so on, are described.

BACKGROUND

Black color materials used in an electrophotographic toner and in an ink for inkjet printing include carbon black, aniline black, black iron oxide, black titanium oxide and the like. Carbon black is an organic pigment having high color density (coloring per unit weight), high blackness degree and high light fastness. However, black pigments are conductive and can form conductive pathways through a toner particle. Often, black toner has low gloss or poor fusing performance.

SUMMARY

The present disclosure describes a black single component toner comprising a styrene/acrylate resin, a black colorant, a further cyan colorant, a low melt wax, and as surface additives, a lubricant and a hydrophobic silica. The surface additives contribute desired compressibility and flowability, which contribute to cleaning performance, fusing performance and so on.

DETAILED DESCRIPTION

I. Definitions

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein are the terms, "equivalent," "similar," "essentially," "substantially," "approximating" and "matching," or grammatic variations thereof, which have generally acceptable definitions or at the least, are understood to have the same meaning as, "about."

II. Toner Particles

Toner particles of interest comprise one or more resins. A toner can comprise more than one form or sort of polymer, such as, two or more different polymers. A polymer can be an alternating copolymer, a block copolymer, a graft copolymer, a branched copolymer, a crosslinked copolymer and so on.

The toner particle can include other optional reagents, such as, a surfactant, a wax, a shell and so on. Among other properties, a toner of interest comprises desirable gloss, flowability, cleaning performance and no toner additive build-up (TAB), those beneficial properties obtained because the additive components are well adhered to the toner surface.

A. Components

1. Resin

Toner particles of the instant disclosure include a resin suitable in forming a particulate containing or carrying a colorant of a toner for use in certain imaging devices. Such a resin, a latex, a plastic, an elastomer and so on, whether naturally occurring or synthetic, is one that can be used in an imaging device. Certain resins, for example, can be used for applications requiring low melting temperature.

One, two or more polymers may be used in forming a toner particle. Where two or more polymers are used, the polymers may be in any suitable ratio (e.g., weight ratio) such as, for instance, with two different polymers, from about 1% (first polymer)/99% (second polymer) to about 99% (first polymer)/1% (second polymer), from about 10% (first polymer)/90% (second polymer) to about 90% (first polymer)/10% (second polymer) and so on, as a design choice.

The polymer may be present in an amount of from about 75 to about 95% by weight, from about 80 to about 94% by weight, from about 85% to about 93% of toner particles on a solids basis.

a. Styrene/Acrylate Resins

Examples include, but are not limited to, a styrene, an acrylate, such as, an alkyl acrylate, such as, methyl acrylate, ethyl acrylate, butyl acrylate, isobutyl acrylate, dodecyl acrylate, n-octyl acrylate, n-butylacrylate, 2-chloroethyl acrylate; β-carboxy ethyl acrylate (β-CEA), phenyl acrylate, methacrylate, butadienes, isoprenes, acrylic acids, acrylonitriles, styrene acrylates, styrene butadienes, styrene methacrylates, and so on, such as, methyl α-chloroacrylate, methyl methacrylate, ethyl methacrylate, butyl methacrylate, butadiene, isoprene, methacrylonitrile, acrylonitrile, vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone, methyl isopropenyl ketone and the like; vinylidene halides, such as, vinylidene chloride, vinylidene chlorofluoride and the like; N-vinyl indole, N-vinyl pyrrolidone, methacrylate, acrylic acid, methacrylic acid, acrylamide, methacrylamide, vinylpyridine, vinylpyrrolidone, vinyl naphthalene, vinyl-N-methylpyridinium chloride, p-chlorostyrene, vinyl chloride, vinyl bromide, vinyl fluoride, ethylene, propylene, butylene, isobutylene and mixtures thereof. A mixture of monomers can be used to make a copolymer, such as, a block copolymer, an alternating copolymer, a graft copolymer and so on.

Examples of latex copolymers include poly(styrene-n-butyl acrylate-β-CEA), poly(styrene-alkyl acrylate), poly(styrene-1,3-diene), poly(styrene-1,2-diene), poly(styrene-1,4-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylonitrile) poly(styrene-alkyl acrylate-acrylic acid), poly(styrene-1,3-diene-acrylic acid), poly(styrene-alkyl methacrylate-acrylic acid), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butylacrylate), poly (methyl methacrylate-isoprene), poly(styrene-butadiene-acrylic acid), poly(styrene-butadiene-methacrylic acid), poly (styrene-butadiene-acrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof, see, for example, U.S. Pat. No. 5,227,460, the entire disclosure of which is incorporated herein by reference.

An example of a composition for making a latex may be one comprising a styrene and an alkyl acrylate, such as, a mixture comprising styrene and n-butyl acrylate. Based on total weight of the monomers, styrene generally may be present in an amount from about 1% to about 99%, from about 50% to about 95%, from about 70% to about 90%, although may be present in greater or lesser amounts; and alkyl acrylate, such as, n-butyl acrylate, generally may be present in an amount from about 1% to about 99%, from about 5% to about 50%, from about 10% to about 30%, although may be present in greater or lesser amounts.

A resin of interest has a molecular weight of from about 20,000 to about 50,000, from about 25,000 to about 45,000, from about 30,000 to about 40,000, as determined, for example, by gel permeation chromatography (GPC). The glass transition temperature ($T_g$) of a resin can be from about 45° C. to about 65° C., from about 47° C. to about 63° C., from about 50° C. to about 60° C.

2. Colorants

In embodiments, black toner can contain, for example, about 5% black colorant, such as, Nipex 35. At that loading, charge, dielectric loss, transfer and image quality (IQ) are at desired levels. While not to be bound by theory, one way to maintain performance with the intent to enable lower TMA is to include one or more colorants or pigments, which generally are of a color other than black, such as, a cyan colorant.

Suitable colorants include, a furnace black, a thermal black, a carbon black, such as, REGAL 330® and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX8600™ and 8610™; Northern Pigments magnetites, NP604™ and NP608™; Magnox magnetites, TMB-100™ or TMB104™; and the like.

Illustrative examples of cyan pigments include copper tetra (octadecylsulfonamido) phthalocyanine, a copper phthalocyanine pigment listed in the Color Index (CI) as CI 74160, CI Pigment Blue (PB), PB 15:3, PB 15:4, an Anthrazine Blue identified in the Color Index as CI 69810, Special Blue X-2137 and the like.

The colorants, for example, a furnace black and a cyan colorant, may be incorporated in amounts sufficient to impart the desired color density. A black colorant may be employed in an amount from about 4% to about 8% by weight of the toner particles on a solids basis, from about 5% to about 7% by weight, from about 6% to about 6.5% by weight. A cyan colorant may be employed in an amount from about 0.5% to about 3% by weight of the toner particles on a solids basis, from about 0.75% to about 2.5% by weight, from about 1% to about 2% by weight.

3. Optional Components a. Surfactants

In embodiments, toner compositions, colorants and so on may be in dispersions including surfactants. One, two or more surfactants may be used. The surfactants may be selected from ionic surfactants and nonionic surfactants, or combinations thereof. Anionic surfactants and cationic surfactants are encompassed by the term, "ionic surfactants."

In embodiments, the surfactant or the total amount of surfactants may be used in an amount of from about 0.01% to about 5% by weight of the toner forming composition, for example, from about 0.75% to about 4% by weight of the toner-forming composition, in embodiments, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhodia as IGEPAL CA-210™, IGEPAL CA520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC® PR/F, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

A toner of the instant disclosure contains a wax, which can be either a single type of wax or a mixture of two or more different types of waxes (hereinafter identified as, "a wax").

The wax may be combined with the resin-forming composition for forming toner particles. Wax may be present in an amount of, for example, from about 2 wt % to about 12 wt % of the toner particles, from about 3 wt % to about 11 wt %, from about 4 wt % to about 10 wt %, from about 7 to about 9 wt % of the toner particles. A wax is one with a melting point of from about 60° C. to about 90° C., from about 70° C. to about 87° C., from about 75° C. to about 85° C., from about 70° C. to about 80° C.

Waxes that may be selected include waxes having, for example, a weight average molecular weight of from about 500 to about 20,000, in embodiments, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

c. Aggregating Factor

An aggregating factor or flocculant may be an inorganic cationic coagulant, such as, for example, a polyaluminum halide, such as, polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or combinations thereof.

In embodiments, the aggregating factor may be added to the mixture at a temperature that is below the $T_g$ of the resin or of a polymer.

The aggregating factor may be present in an amount of, for example, from about 0.15 parts per hundred (pph) to about 0.175 pph, from about 0.155 to about 0.17 pph, from about 0.16 to about 0.165 pph.

The aggregating factor may also contain minor amounts of other components, for example, nitric acid.

In embodiments, a sequestering agent or chelating agent may be introduced after aggregation is complete to sequester or extract a metal complexing ion, such as, aluminum from the aggregation process. Thus, the sequestering, chelating or complexing agent used after aggregation is complete may comprise an organic complexing component, such as, ethylenediaminetetraacetic acid (EDTA), gluconal, hydroxyl-2, 2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyaspartic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1, 1-diphosphonic acid, aminotrimethylenephosphonic acid, diethylene triaminepentamethylene phosphonic acid, ethylenediamine tetramethylene phosphonic acid, and mixtures thereof.

d. Surface Additives

In embodiments, the toner particles may be mixed with one or more of silicon dioxide or silica ($SiO_2$). Silica may be a first silica and a second silica. The first silica may have an average primary particle size, measured in diameter, in the range of, for example, from about 10 nm to about 18 nm, from about 12 nm to about 16 nm, from about 13 nm to about 15 nm. A second silica may be used, with a size no larger than that of the first silica. A silica can be a fumed silica. A silica can be treated with a polymer to attain a desired property, such as, hydrophobicity, flowability and so on. Thus, a silica can be coated with a siloxane polymer, such as, a polydimethylsiloxane. Such coated silicas for tuning rheological properties are available commercially, such as, TS-720 available from Cabot Corp. The total amount of silica on a toner particle, on a weight basis, is from about 0.9 wt % to about 2.5 wt %, from about 1 wt % to about 2 wt %, from about 1.2 to about 1.6 wt %.

Magnesium stearate may be used as a lubricant. Calcium stearate and zinc stearate may provide similar functions. A lubricant may have an average primary particle size in the range of, for example, from about 500 nm to about 700 nm, from about 500 nm to about 600 nm, from about 550 nm to about 650 nm. A lubricant is used, on a weight basis, in an amount from about 0.05 wt % to about 0.5 wt %, from about 0.07 wt % to about 0.3 wt %, from about 0.09 to about 0.2 wt %, from about 0.1 wt % to about 0.18 wt %.

B. Toner Particle Preparation

1. Method a. Particle Formation

The toner particles may be prepared by any method within the purview of one skilled in the art, for example, any of the emulsion/aggregation (E/A) methods may be used with a resin and the first and second colorants as taught herein. Any suitable method of preparing toner particles may be used, including chemical processes, such as, suspension and encapsulation processes disclosed, for example, in U.S. Pat. Nos. 5,290,654 and 5,302,486, the disclosure of each of which hereby is incorporated by reference in entirety; by conventional granulation methods, such as, jet milling; pelletizing slabs of material; other mechanical processes; any process for producing nanoparticles or microparticles; and so on.

In embodiments relating to an E/A process, a resin may be dissolved in a solvent, and may be mixed into an emulsion medium, for example water, such as, deionized water, optionally containing a stabilizer, and optionally a surfactant, for example, at room temperature (RT). Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer is used, the stabilizer may be present in amounts of from about 0.1% to about 5%, from about 0.5% to about 3% by weight of the resin. When such salts are added to the composition as a stabilizer, in embodiments, incompatible metal salts are not present in the composition, for example, a composition may be completely or essentially free of zinc and other incompatible metal ions, for example, Ca, Fe, Ba etc., that form water-insoluble salts. The term, "essentially free," refers, for example, to the incompatible metal ions as present at a level of less than about 0.01%, less than about 0.005% or less than about 0.001%, by weight of the wax and resin. The stabilizer may be added to the mixture at ambient temperature, or may be heated to the mixture temperature prior to addition.

Following emulsification, toner compositions may be prepared by aggregating a mixture of a resin, the first and second colorants of interest, the wax and any other desired additives in an emulsion, optionally, with surfactants as described above, and then optionally coalescing the aggregate mixture. A mixture may be prepared by adding the wax or other materials, which may also be optionally in a dispersion, including a surfactant, to the emulsion comprising a resin and the first and second colorants, which may be a mixture of two or more emulsions containing the requisite reagents for producing toner. The pH of the particle-forming mixture may be adjusted with an acid, such as, for example, acetic acid, nitric acid or the like. In embodiments, the pH of the mixture may be adjusted to from about 2 to about 4.5.

b. Aggregation

Following preparation of the above mixture, often, it is desirable to form larger particles or aggregates, often sized in micrometers, of the smaller particles from the initial emulsion, often sized in nanometers. An aggregating factor may be added to the mixture. Suitable aggregating factors include, for example, aqueous solutions of a divalent cation, a multivalent cation or a compound comprising same.

To control aggregation of the particles, the aggregating factor may be metered into the mixture over time. For example, the factor may be added incrementally into the mixture over a period of from about 5 min to about 240 minutes, from about 30 to about 200 minutes.

Addition of the aggregating factor also may be done while the mixture is maintained under stirred conditions, such as, from about 50 rpm to about 1,000 rpm, in embodiments, from about 100 rpm to about 500 rpm; and at a temperature that is below the $T_g$ of the resin or polymer. The growth and shaping of the particles following addition of the aggregation factor may be accomplished under any suitable condition(s).

The particles may be permitted to aggregate until a predetermined desired particle size is obtained, such as, from about 5.4 to about 6.2 μm, from about 5.6 to about 6 μm, from about 5.7 to about 5.9 μm. Particle size may be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature and holding the mixture at that temperature for from about 0.5 hours to about 6 hours, from about hour 1 to about 5 hours, while maintaining stirring, to provide the desired aggregated particles. Once the predetermined desired particle size is attained, the growth process is halted.

In embodiments, after aggregation, but prior to coalescence, a resin coating may be applied to the aggregated particles to form a shell thereover. Any resin described herein or as known in the art may be used as the shell. A shell sequesters wax, pigment and so on in the toner and away from the toner particle surface.

A shell resin may be applied to the aggregated particles by any method within the purview of those skilled in the art. In embodiments, the resins used to form the shell may be in an emulsion, optionally including any surfactant described herein. The emulsion possessing the resins may be combined with the aggregated particles so that the shell forms over the aggregated particles.

The core-shell particle can have a size of from about 5 to about 7 μm, from about 5.5 to about 6.8 μm, from about 6 to about 6.6 μm.

To stop particle growth, if a shell is present, after the shell is formed, the pH of the emulsion can be increased, for example, to about 7, the temperature can be increased to above the $T_g$, or both. Hence, pH of the mixture may be adjusted with base to a value of from about 6 to about 10, from about 6.5 to about 7.5. The base used to stop toner particle growth may be, for example, an alkali metal hydroxide, such as, for example, sodium hydroxide, potassium hydroxide, ammonium hydroxide, combinations thereof and the like. In embodiments, EDTA may be added to assist adjusting the pH to the desired value.

c. Coalescence

Following aggregation to a desired particle size and application of any optional shell, the particles then are coalesced to a desired final shape, such as, a circular shape, for example, to correct for irregularities in shape and size, the coalescence being achieved by heating the mixture to a temperature from about 80° C. to about 110° C., from about 87° C. to about 100° C., from about 90° C. to about 96° C., and/or reducing the stirring, for example, to from about 1000 rpm to about 100 rpm, from about 800 rpm to about 200 rpm. Coalescence may be conducted over a period from about 0.01 to about 9 hours, from about 0.1 to about 4 hours, see, for example, U.S. Pat. No. 7,736,831. The particles are coalesced until the particles achieve a circularity, as measured with a Sysmex 3000 device, of from about 0.96 to about 0.99, from about 0.965 to about 0.985, from about 0.97 to about 0.98.

After aggregation and/or coalescence, the mixture may be cooled to room temperature, such as, from about 20° C. to about 25° C. The cooling may be rapid or slow, as desired. A suitable cooling method may include introducing cold water to a jacket around the reactor. After cooling, the toner particles optionally may be washed with water and then dried. Drying may be by any suitable method, including, for example, freeze drying.

d. Surface Additives

Surface additives may be added to the toner compositions of the present disclosure, for example, after washing or drying. Thus, a toner, silica and lubricant are combined and blended, for example, in a Henschel blender, under conditions, such as, at least about 35 watt×hr/lb./% silica, to achieve additive adhesion force distribution (AAFD) of at least about 68% remaining at 3000 joules, at least about 70%, at least about 72% remaining at 3000 joules; of at least about 58% remaining at 6000 joules, at least about 60%, at least about 62% remaining at 6000 joules; of at least about 13% remaining at 12000 joules, at least about 15%, at least about 17% remaining at 12000 joules, practicing the materials and methods provided in U.S. Pat. Nos. 6,508,104 and 6,598,466.

The gloss of a toner may be influenced by the amount of retained metal ion, such as, $Al^{3+}$, in a particle. The amount of retained metal ion may be adjusted by the amount of aggregating factor or flocculant comprising a metal ion used in aggregation. The gloss level of a toner of interest may have a gloss, as measured by Gardner gloss units (ggu), of from about 10 ggu to about 100 ggu, from about 20 ggu to about 95 ggu, from about 30 ggu to about 90 ggu.

The melt flow index (MFI) of a toner can be, using a Tinius Olsen device at 130° C. and an applied load of 5 kg of at least about 15 g/10 min, at least about 20 g/10 min, at least about 25 g/10 min. MFI as used herein includes, for example, the weight of a toner (in grams) which passes through an orifice of length L and diameter D in a 10 minute period with a specified applied load. An MFI unit of 1 thus indicates that only 1 gram of the toner passed through the orifice under the specified conditions in 10 minutes time. "MFI units," as used herein thus refers to units of grams per 10 minutes.

Other characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer.

Compressibility of a toner of interest, as determined using known materials and methods, such as, using a Freeman FT4 powder rheometer, can be from about 5% to about 11% at 10 kPa, from about 6% to about 10%, from about 7% to about 9% at 10 kPa.

A desirable characteristic of a toner is sufficient release of the paper image from the fuser roll. Thus, a toner characteristic for contact fusing applications is that the fusing latitude, that is, the temperature difference between the minimum fixing temperature (MFT) and the hot offset temperature, should be from about 50° C. to about 100° C., from about 75° C. to about 100° C., from about 80° C. to about 100° C. and from about 90° C. to about 95° C.

For the evaluation of toner particles, for example, in the examples that follow, the parent charge can be measured by conditioning the toner at a specific TC (toner concentration, e.g., 8%) in both the A-zone and the C-zone overnight, followed by charge evaluation after either 2 min or 60 min of mixing on a Turbula mixer. Humidity sensitivity is an important charging property for EA toners. The charging performance can be tested in two chambers, one is a low humidity zone (known as the C-zone), while another is a high humidity zone (known as the A-zone). The quantity of charge is a value measured through image analysis of the charge-spectrograph process (CSG). Toner charge-to-diameter ratios (q/d) in the C-zone and A-zone, typically with a unit of femtocoulombs/(mm), can be measured on a known standard charge spectrograph.

Toners of the instant disclosure also may possess a parent toner charge per mass ratio (q/m) of from about −5 μC/g to about −90 μC/g, and a final toner charge after surface additive blending of from about −15 μC/g to about 80 μC/g.

IV. Devices Comprising a Toner Particle

Toners may be combined with a number of devices ranging from enclosures or vessels, such as, a vial, a bottle, a flexible container, such as a bag or a package, and so on, to devices that serve more than a storage function.

A. Imaging Device Components

The toner of interest may be incorporated into devices dedicated, for example, to delivering same for a purpose, such as, forming an image. Hence, particularized toner delivery devices are known, see, for example, U.S. Pat. No. 7,822,370, and may contain a toner of interest. Such devices include cartridges, tanks, reservoirs and the like, and may be replaceable, disposable or reusable. Such a device may comprise a storage portion; a dispensing or delivery portion; and so on; along with various ports or openings to enable toner addition to and removal from the device; an optional portion for monitoring amount of toner in the device; formed or shaped portions to enable siting and seating of the device in, for example, an imaging device; and so on.

B. Toner Delivery Device

A toner of interest may be included in a device dedicated to delivery thereof, for example, for recharging or refilling toner in an imaging device component, such as, a cartridge, in need of toner, see, for example, U.S. Pat. No. 7,817,944, wherein the imaging device component may be replaceable or reusable.

V. Imaging Devices

The toners may be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The electrophotographic device may include a high speed printer, a color printer and the like.

Once the image is formed with toners via a suitable image development method, such as any of the aforementioned methods, the image then may be transferred to an image receiving medium or substrate, such as, a paper and the like. In embodiments, the fusing member or component, which may be of any desired or suitable configuration, such as, a drum or roller, a belt or web, a flat surface or platen, or the like, may be used to set the toner image on the substrate. Optionally, a layer of a liquid, such as, a fuser oil can be applied to the fuser member prior to fusing.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The following Examples illustrate embodiments of the instant disclosure. The Examples are intended to be illustrative only and are not intended to limit the scope of the present disclosure. Parts and percentages are by weight unless otherwise indicated. As used herein, RT refers to a temperature of from about 20° C. to about 30° C.

EXAMPLES

Example 1

An E/A black particle was made by homogenizing a styrene butylacrylate resin with two pigment dispersions, carbon black (3-7 wt/wt %) and cyan 15.3 (0.5-1.5 wt/wt %), a paraffin wax dispersion (4-12 wt %) as well as polyaluminum chloride (PAC) (0.12-0.18 pph) at room temperature. The mixture was than heated to the temperature slightly below the $T_g$ of the resin (54° C.) while mixing, to enable particle growth to 5.8 μm. A shell was then added using the same resin and incubation continued until the particles achieved 6.4 μm. To prevent further growth of the particle, sodium hydroxide solution was added and the temperature in the reactor was increased above the resin $T_g$. The particles are then coalesced at 94° C. until a circularity of 0.975 is obtained (as measured by Sysmex 3000). Particles were wet sieved, washed by filtration three times and dried. The resulting particles were than blended with TS-720 silica (Cabot) (1.3-1.65 wt %) and magnesium stearate (0.1-0.5 wt %) to produce toner.

That basic formula was practiced and reagents and conditions varied as noted above, and with the remainder of each formulation made up to 100% with resin to determine when fusing performance and other parameters of interest were maximized. For example, blending conditions of toner with silica and lubricant were optimized to enable an additive adhesion force distribution (AAFD) that was at least 68% remaining at 3 k joules, at least 58% remaining at 6 k joules and at least 13% remaining at 12 k joules (see Table 1). As noted from the data of Table 1, all of those baseline values were far exceeded. Additive content was selected to minimize compressibility using a Freeman FT4 rheometer (see Table 2). The gloss of the experimental toner was at an acceptable level, see Table 3. PAC and wax amounts were varied to optimize MFI for fusing and AAFD.

TABLE 1

AAFD comparison of control and experimental black toner
Additive Adhesion Force of Additive to Toner

| Toner | 3 KJ | 6 KJ | 12 KJ |
|---|---|---|---|
| Control Black | 78.7 | 72.9 | 53.9 |
| Experimental Black | 89.1 | 83 | 70.7 |

TABLE 2

Compressibility comparison of control and experimental black toner
Compressibility of Toner

| Toner | % | SD |
|---|---|---|
| Control Black | 7.7 | 0.02 |
| Experimental Black | 7.21 | 0.03 |

TABLE 3

Gloss comparison of control black and experimental black toner
Gloss of Toner (75 degree)

| Toner | ggu |
|---|---|
| Control Black | 20 |
| Experimental black | 25 |

Hence, final particle size, final particle shape and MFI were maximized using resins of size, amount and $T_g$ of interest, low melting point paraffin waxes in amounts of interest, along with amounts and types of silica and lubricants of interest as surface additives, applied as taught herein.

It will be appreciated that various features of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. An emulsion aggregation black toner comprising a styrene/acrylate resin, an optional surfactant, a wax comprising a paraffin wax, wherein the wax is in an amount from about 2% to about 12% by weight of toner, a shell, a black colorant, a cyan colorant, and on the surface of said toner a silica of about 10 nm to about 18 nm in size, with an adhesive force distribution of at least about 68% remaining at 3000 joules, and a lubricant comprising a magnesium stearate, wherein the lubricant is in an amount from about 0.05% to about 0.5% by weight of toner, wherein said toner comprises a melt flow index of at least about 15 g/10 min and comprises a compressibility of from about 5% to about 11% at 10 kPa.

2. The toner of claim 1, wherein said black colorant is in an amount of from about 4% to about 8% by weight of toner.

3. The toner of claim 1, wherein said cyan colorant comprises pigment blue 15:3.

4. The toner of claim 1, wherein said cyan colorant is in an amount of from about 0.5% to about 3% by weight of toner.

5. The toner of claim 1, wherein said resin comprises a molecular weight of from about 20,000 to about 50,000.

6. The toner of claim 1, wherein said resin comprises a glass transition temperature of from about 45° C. to about 65° C.

7. The toner of claim 1, wherein said was comprises a melting point of from about 60° C. to about 90° C.

8. The toner of claim 1, wherein said black colorant comprises a carbon black in an amount from about 3% to about 7% by weight of toner.

9. The toner of claim 1, wherein said paraffin wax is in an amount from about 4% to about 12% by weight of toner.

10. The toner of claim 1, wherein said toner comprises a styrene butylacrylate resin.

11. The toner of claim 1, wherein said lubricant is in an amount from about 0.07% to about 0.3% by weight of toner.

12. The toner of claim 1, wherein said silica is hydrophobic.

13. The toner of claim 1, wherein said silica comprises a coating.

14. The toner of claim 1, wherein said silica is in an amount from about 0.9% to about 2.5% by weight of toner.

15. The toner of claim 1, wherein said silica is in an amount from about 1% to about 2% by weight of toner.

16. The toner of claim 1, wherein said lubricant comprises an average particle size from about 500 nm to about 700 nm.

17. The toner of claim 1, comprising a compressibility of from about 6% to about 10% at 10 kPa.

18. The toner of claim 1, comprising a size from about 5 μm to about 7 μm.

19. The toner of claim 1, comprising a circularity of from about 0.96 to about 0.99.

20. The toner of claim 1, comprising an additive adhesion force distribution of at least about 58% remaining at 6000 joules, at least about 13% remaining at 12000 joules or both.

* * * * *